US007922417B2

(12) United States Patent
Jimenez

(10) Patent No.: US 7,922,417 B2
(45) Date of Patent: Apr. 12, 2011

(54) INTERLOCKING STRUCTURAL ELEMENT FOR CABINETS AND ENCLOSURES

(76) Inventor: Luis Alejandro Jimenez, Moultonborough, NH (US)

( * ) Notice: Subject to any disclaimer, the term of this patent is extended or adjusted under 35 U.S.C. 154(b) by 748 days.

(21) Appl. No.: 11/807,037

(22) Filed: May 25, 2007

(65) Prior Publication Data

US 2008/0290771 A1 Nov. 27, 2008

(51) Int. Cl.
*E04B 1/26* (2006.01)

(52) U.S. Cl. ..... 403/364; 312/111; 108/193

(58) Field of Classification Search ..... 211/182, 211/183, 189; 312/265.1–265.4, 107, 108, 312/111, 263; 108/180, 185, 193, 147.16; 52/271, 282.1, 282.3, 780, 653.2, 79.12, 52/588.1, 574; 403/265, 267, 292, 364; D25/61, D25/109, 118, 119, 125

See application file for complete search history.

(56) References Cited

U.S. PATENT DOCUMENTS

| | | | | | |
|---|---|---|---|---|---|
| 2,167,525 | A | | 7/1939 | Rosendale | |
| 3,044,658 | A | * | 7/1962 | Combs et al. | 220/683 |
| 3,182,846 | A | | 5/1965 | LaKaff | |
| 3,265,419 | A | | 8/1966 | Dumbaugh | |
| 3,751,127 | A | * | 8/1973 | Black et al. | 312/111 |
| 3,919,603 | A | | 11/1975 | Salvati | |
| 4,123,129 | A | * | 10/1978 | Butler | 312/265.3 |
| 4,470,647 | A | * | 9/1984 | Bishoff et al. | 312/111 |
| 4,585,131 | A | * | 4/1986 | Crossman et al. | 211/206 |
| 4,621,938 | A | * | 11/1986 | Weilow | 403/217 |
| 5,039,177 | A | * | 8/1991 | Newell et al. | 312/111 |
| 5,066,161 | A | | 11/1991 | Pinney | |
| 5,429,438 | A | | 7/1995 | Wood | |
| D362,509 | S | * | 9/1995 | Russell | D25/61 |
| 5,470,139 | A | * | 11/1995 | Hsiao | 312/140 |
| 5,695,263 | A | * | 12/1997 | Simon et al. | 312/265.4 |
| 5,746,333 | A | * | 5/1998 | Wuertemberger | 211/189 |
| 5,888,114 | A | * | 3/1999 | Slocum et al. | 446/128 |
| D412,585 | S | * | 8/1999 | Arcati et al. | D25/124 |
| 6,030,063 | A | * | 2/2000 | Benner | 312/265.1 |
| 6,082,837 | A | * | 7/2000 | Battochio et al. | 312/140 |
| 6,120,116 | A | * | 9/2000 | Phillips | 312/223.2 |
| 6,223,917 | B1 | * | 5/2001 | Bruder | 211/189 |
| 6,802,171 | B2 | * | 10/2004 | McKinnon | 52/762 |
| 6,837,389 | B2 | * | 1/2005 | Gassler | 211/189 |
| 2005/0129460 | A1 | * | 6/2005 | Medcalf et al. | 403/403 |

* cited by examiner

*Primary Examiner* — Darnell M Jayne
*Assistant Examiner* — Patrick Hawn
(74) *Attorney, Agent, or Firm* — Jonathan Barry

(57) ABSTRACT

An interlocking structural element is disclosed for the construction of cabinets and enclosures, including modular cabinets and enclosures. Four equal lengths of the interlocking structural element can be used in conjunction with simple flat rectangular panels to fabricate a single enclosure. Additional lengths may be used to fabricate an enclosure with multiple compartments. The interlocking structural element may be fabricated by extruding metal or other material such as plastic. The element incorporates slots for easy mounting of shelves, printed circuit boards or other objects within the enclosure.

8 Claims, 7 Drawing Sheets

INTERLOCKING STRUCTURAL ELEMENT FOR CABINETS AND ENCLOSURES

FIELD OF THE INVENTION

The invention relates generally to cabinets and enclosures, and more particularly to structural elements used to fabricate cabinets and enclosures.

BACKGROUND OF THE INVENTION

Cabinets and enclosures are used to house and protect a wide variety of items, which may vary greatly in size and shape. A variety of cabinet configurations have been developed for the protection of items such as electrical and electronic assemblies, vacuum tubes and other easily damaged components of the past, and state-of-the-art compact high speed hybrid and digital circuits. Today, electronic assemblies differ as to the space and proportions necessary to house them. While a cabinet the size of several cubic feet may be necessary to house a high voltage system or a multi-server system, a cabinet the size of a pack of cigarettes may be needed to house a compact electrical or embedded electronics arrangement. There are many cabinet and enclosure structures available in many sizes. However, users of such enclosures are limited to either choosing a standard size enclosure, which may be too large for their applications; or fabricating a custom size enclosure, which may require welding, a large amount of machining, or high tooling costs.

In many situations, it is beneficial to use a cabinet with multiple compartments. For example, in the case of an electrical circuit or circuits, it may be desirable to separate a high voltage section from a low voltage section, or a particularly noise-sensitive circuit from other circuits. In such cases, custom fabrication becomes considerably more difficult. Means for construction of a cabinet or enclosure or a set of modular interconnected cabinets or enclosures that provides strength, ease of assembly, and appropriate size for a particular application, large or small, has yet to be realized.

A number of attempts have been made to provide a cabinet which satisfies these criteria, but typically the cost or the complexity, the size, versatility or strength has been less than desirable. By way of example, the following U.S. patents disclose either welded or modular frame assemblies representative of cabinet structures developed in the prior art:

U.S. Pat. No. 2,167,525: Rosendale
U.S. Pat. No. 5,066,161: Pinney
U.S. Pat. No. 3,265,419: Durnbaugh, et al.
U.S. Pat. No. 3,182,846: La Kaff
U.S. Pat. No. 3,919,603: Salvati The patents to Rosendale and Durnbaugh et al both disclose welded cabinet structures. Rosendale employs gussets, triangular pieces of metal, welded in each corner to hold three mutually perpendicular struts in a corner arrangement. Durnbaugh et al eliminates such gusset members and welds the strut members directly to each other at their intersection. However, each of the three strut members which form each corner have different end cross-sectional configurations and end profiles, which complicates manufacture and construction of the frame. Additionally, four welds are desired to join the struts to create a rigid frame structure. The cabinet structures of Rosendale and Durnbaugh et al therefore, are very labor intensive.

The patents to La Kaff and Salvati disclose cabinet configurations that involve mechanical assembly. In La Kaff, side frame struts are coupled to the top and base members using engaging elements formed of generally rectangular aluminum blocks, which are attached by welding to the top and bottom members and struts. The engaging elements have frustoconical portions configured to fit snugly together. The top and base members are matted via the engaging elements, and bolted together. Both manufacturing cost and lack of versatility make this frame an undesirable alternative. Salvati et al disclose a switchgear framework including a corner tie for supporting three structural corner members together. The corner tie has three rectangular-shaped perpendicular legs with three sides and outwardly facing flanges, the three struts being slid over the leg portions. However, the struts and leg portions have different cross-sectional configurations, and the corner tie is of a generally complex configuration, such that this frame structure is not conducive to low-cost manufacturing techniques.

The Pinney patent discloses a simplified cabinet frame structure element, however, bending, cutting at angles on corners, and welding processes may be required, which are not conducive to low-cost manufacturing techniques.

In the discovered prior art, welding is commonly used to join the frame elements together. Another development is known as T-slot or 80/20 aluminum extrusion. This is a family of extruded aluminum products intended for use in rapid frame construction for enclosures and other assemblies. It is manufactured in a variety of profiles with a variety of accessories, however there are shortcomings. Accessories such as sliding wear pads are required for most assemblies. Further, a large amount of machining and accessories is required to fabricate an enclosure with multiple compartments.

It would be advancement in the art to provide an enclosure and cabinet system based on frame elements of a single particular cross-sectional shape that allows rapid, low-cost, custom fabrication of enclosures with no welding required, little or no machining required, high strength, and modularity.

SUMMARY OF THE INVENTION

It is therefore and object of the present invention to provide a means for rapid, low-cost construction of cabinets or enclosures employing interlocking structural elements. The enclosures are generally rectangular in shape, and may be made in practically any size with practically any aspect ratio. Structural elements in accordance with the invention include interlocking means, wherein two or more cabinets can be linked together to form larger cabinets with multiple internal compartments. The structural elements also may include means for mounting components, shelves, circuit boards or other objects within the enclosure.

Structural elements in accordance with the invention are elongated struts of essentially constant cross-section, which may be formed by an extrusion process or other means. They are used to form the corner supports of the rectangular enclosure and, accordingly, resemble extruded angle iron in their basic shape. The structural elements comprise two flanges of essentially equal width at right angles to each other. The flanges are of sufficient thickness that a slot can be incorporated into them for fixing the side panels of the enclosure. The side panels may be made from flat plates of any suitable material.

Structural elements in accordance with the invention further comprise one or more interlocking protrusions on the outer surface of each flange. The protrusions are shaped and positioned such that two identical structural elements can slide together and interlock with each other, with a first side of the first element interlocking the second side of the second element. When interlocked, the non-interlocking flanges of each member are substantially coplanar. It is this interlocking feature of the invention that enables the rapid fabrication of cabinets with multiple compartments.

Structural elements in accordance with the invention may further comprise additional slots on the inside surfaces for mounting of shelves or other components within the finished enclosure. Additionally, holes may be located in the corner of the elements for later threading; such holes to be used to mount cover plates or other items on the enclosure. Grooves may also be incorporated into the structural elements to aid in locating machined features during enclosure fabrication.

DETAILED DESCRIPTION OF THE INVENTION

The present invention comprises a structural element which can be used to fabricate cabinets and enclosures with one or more compartments. The element is an elongated member with at least two surfaces and means for interlocking two elements together. Such means are typically comprised of elongated protrusions on the outer surfaces of each flange, shaped and positioned for proper interlocking.

Figure 1:
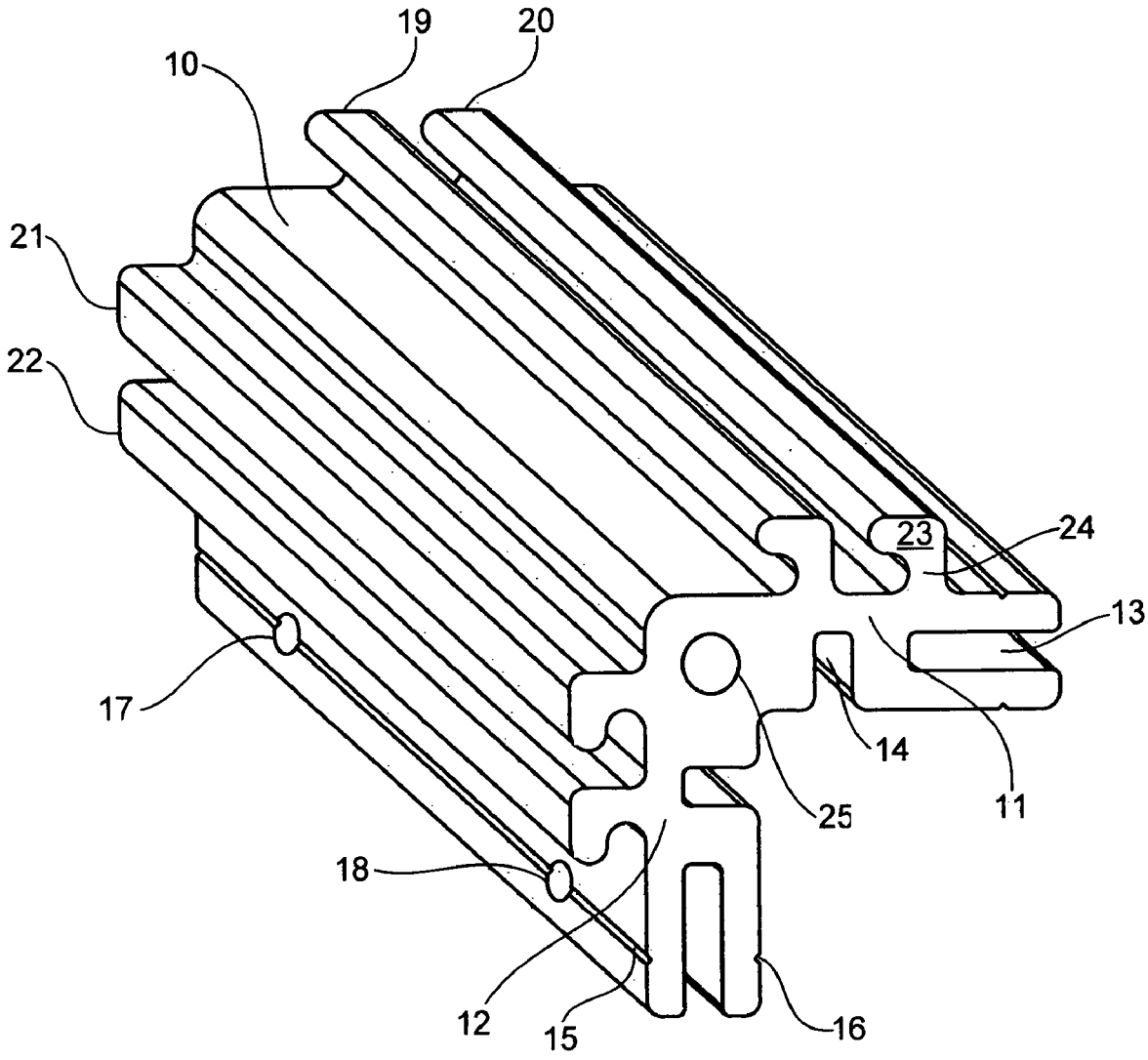
FIG. 1 is a perspective view of a structural element in accordance with the present invention.

The preferred embodiment of a structural element in accordance with the invention is shown in FIG. 1. The structural element 10 is used in the corner of the compartment or cabinet and accordingly has a top flange 11 and a side flange 12 which are at approximately a right angle to each other.

Each flange incorporates two slots 13 14 for a total of four slots. One slot 13 is parallel to the plane of the flange. The second slot 14 is perpendicular to the plane of the flange. The parallel slots are used to fix the side panels of the enclosure, while the perpendicular slots are used to mount a shelf within the enclosure.

The preferred embodiment of the invention includes v-grooves 15 16 in the top and bottom surfaces of each flange. The v-grooves 15 16 are used to locate holes 17 18 for fixing the outer wall of the enclosure to the structural element. The preferred embodiment also includes a hole 25 near the vertex of the angle between the top and side flanges 11 12. This hole 25 extends the length of the element and may be used to fix the front and back panels onto the enclosure.

To achieve interlocking capability, outward extending protrusions 19 20 21 22 are located on the outer surface of each flange. In the preferred embodiment, the protrusions have a generally hook shaped cross section with a head 23 and a neck 24. All four protrusions 19 20 21 22 are identical in shape, but they are located in different positions along the width of the flanges.

The cross section of the structural element is substantially uniform along the length of the element. The uniformity of the cross section is such that the preferred embodiment of the structural element may be suitably manufactured using an extrusion process.

Figure 2:
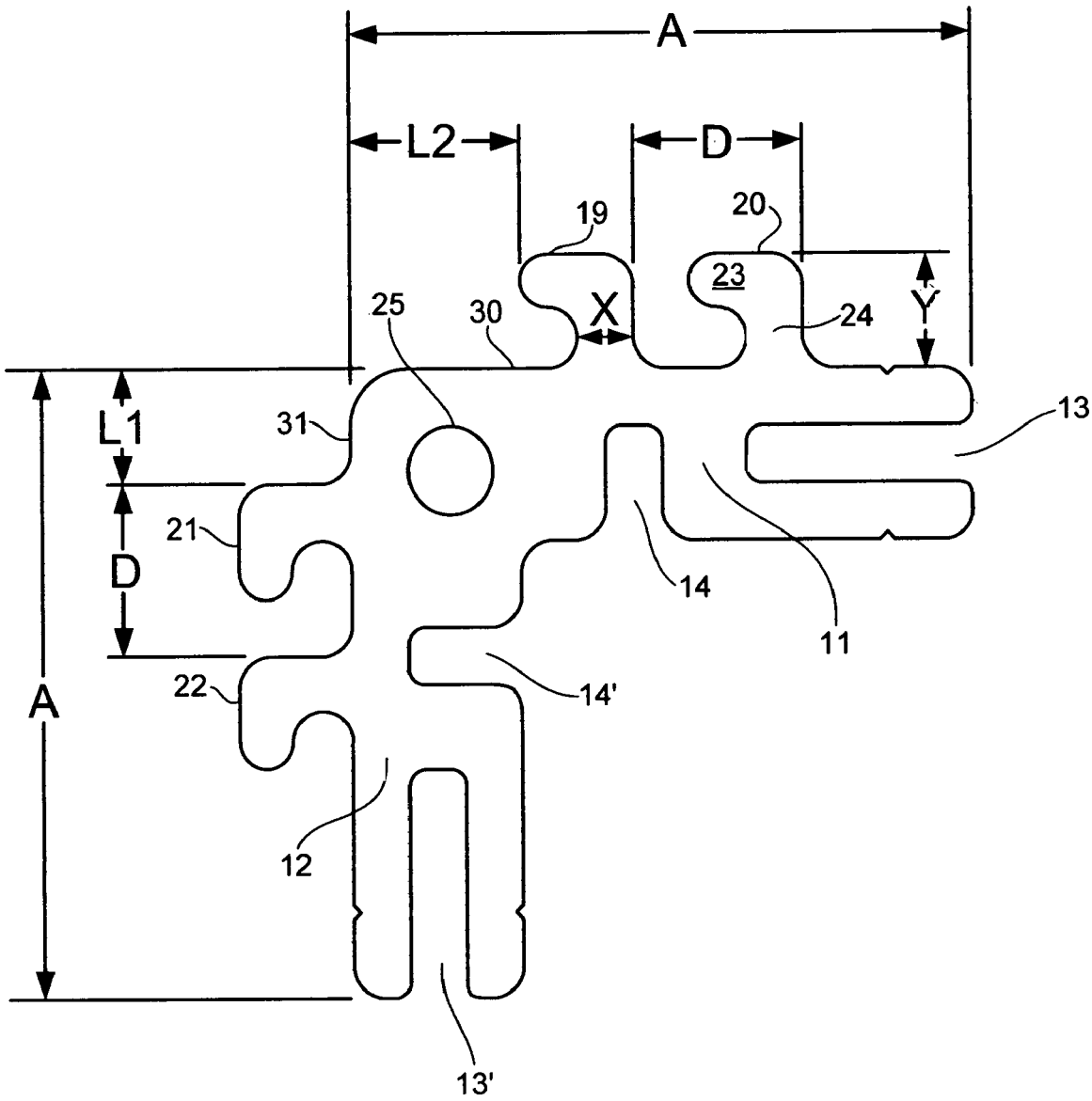
FIG. 2 is a cross-sectional view of the structural element, including some dimensional proportions.

Some of the dimensional proportions of the cross section of the various features of the element in accordance with the invention are shown in FIG. 2. Each flange forming the right angle cross section has equal width, designated as dimension A. Each flange 11 12 includes a slot 13 13' parallel to the plane of the flange, extending inward toward the vertex of the right angle. While the width and depth of the slot may vary considerably, dimensions should be chosen that permit fixing of the side panels of the enclosure without unduly compromising the structural strength of the member.

The two flanges 11 12 also include a slot 14 14' perpendicular to the plane of the flange. These slots are useful for mounting shelves, circuit boards, or other objects in the final enclosure. Additionally, a hole 25 is located near the vertex of the right angle between the flanges. Preferably, the diameter of the hole should be chosen so that it can be threaded and used to secure the front and back panels onto the enclosure with suitably sized screws. Alternately, rivets or other fastening means may be used.

On the outer surface of each flange of the preferred embodiment of the structural element are located protrusions 19 20 21 22 to provide means for interlocking two identical structural elements together. All four protrusions in the preferred embodiment are identical in cross section, but vary in orientation and position relative to the vertex and edge of each flange. The pair of protrusions on the top flange has the same spacing relative to each other as the pair of protrusions on the side flange, denoted as dimension D. Further, in the preferred embodiment, each protrusion is generally hook shaped, with a head 23 and a neck 24. The heads of the protrusions on the top flange point toward the vertex of the right angle between the flanges, while the heads of the protrusions on the side flange point away from the vertex of the right angle between the flanges.

In FIG. 2, the width of the necks of each protrusion is denoted as dimension X, and the height as dimension Y. Dimensions L1 and L2 indicate the position of the protrusions relative to the outer surface of the flanges 30 31. In the preferred embodiment, L2 is larger than L1 by an amount approximately equal to X. That is, L2=L1+X. The height of the protrusions, Y, is approximately twice the width of the neck, Y=2X.

Figure 3:
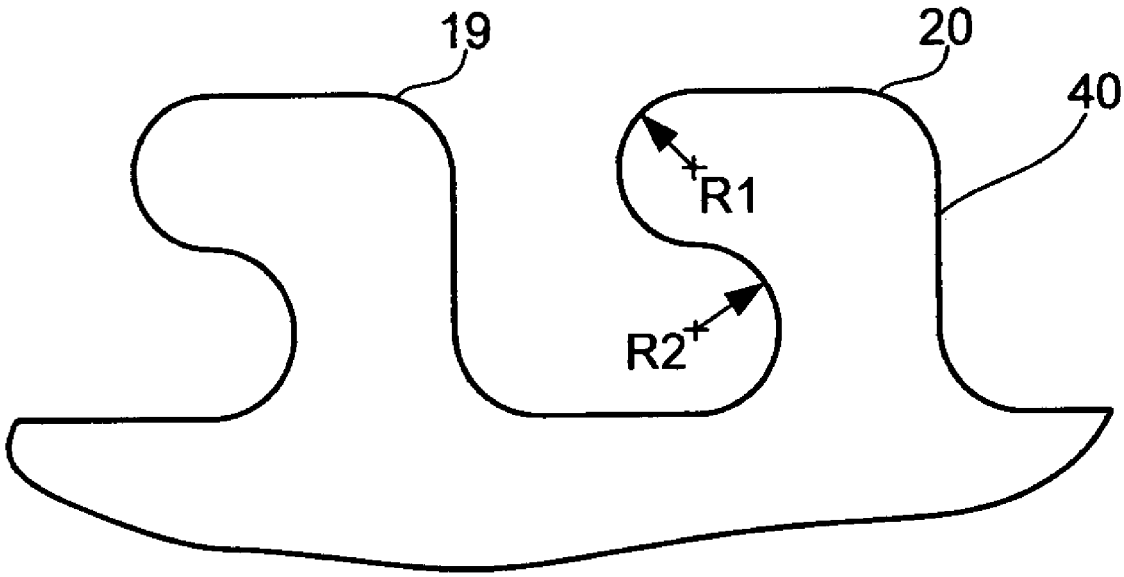
FIG. 3 is an enlarged view of interlocking protrusions in accordance with the invention, including some dimensional proportions.

FIG. 3 shows a closer view of the cross section of the interlocking protrusions 19 20. The exact dimensions of the protrusions are chosen such that the space between the protrusions is slightly larger than a single protrusion and comparably shaped.

The surface on one side of the each protrusion 40 is approximately flat, while the other side is formed from two semi-circular surfaces with radii R1 and R2. In order to ensure proper interlocking capability, R2 is chosen to be slightly larger than R1. While the exact difference may vary considerably, R2 is normally about 1% to 5% greater than R1. If the difference between the radii is too large, the interlocked elements will have too much freedom of motion. If the difference is too small, it may be difficult to slide two interlocking pieces together, especially if the pieces are long. In the preferred embodiment, the centers of the two radii, R1 and R2, are aligned in the vertical direction. The height of the protrusion, Y, is approximately twice the sum of the two radii, R1 and R2.

Figure 4:
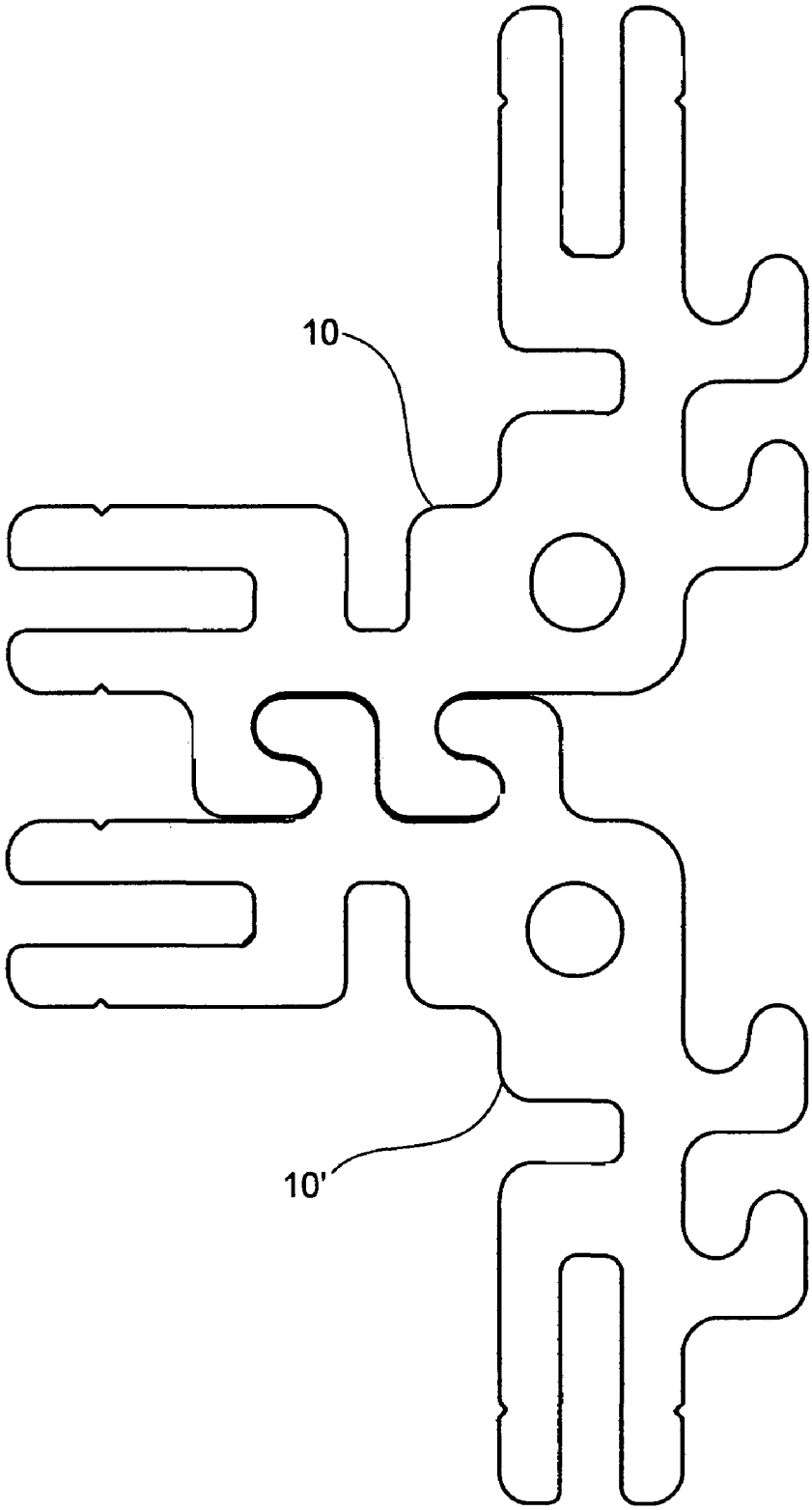
FIG. 4 is a cross-sectional view of two structural elements interlocked.

FIG. 4 shows an end view of two identical structural elements 10 10' interlocked in accordance with the invention. The protrusions on the top flange of a -first element interlock with the protrusions on the side flange of the second element. The interlocking is achieved by placing the elements end to end and sliding the second element into position relative to the first element.

Figure 5:
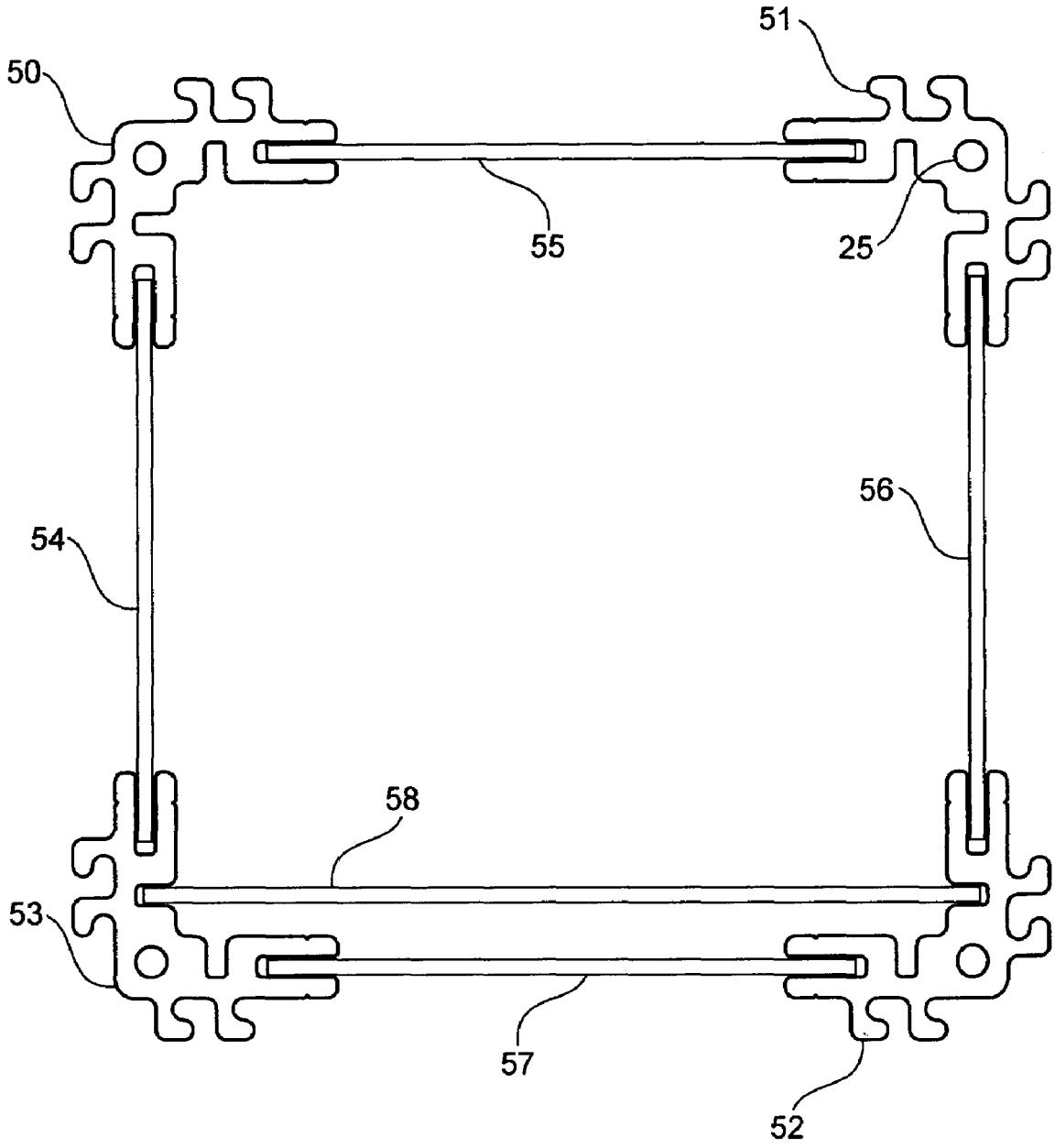
FIG. 5 is a front view of a cabinet structure, including an internal mounting plate, with front and back covers removed.

FIG. 5 shows an enclosure using structural elements in accordance with the preferred embodiment. Four identical elements 50 51 52 53 are placed at each corner of the enclosure and joined by four flat panels 54 55 56 57. The panels may be made from any rigid material such as sheet metal or fiberglass. They are fixed to the structural elements with screws or other suitable means. A shelf 58 may be slid into slots in the structural elements. A front and back panel are affixed to the structural elements using the holes 25 near the corner of the structural elements and suitable fixing means such as screws or rivets.

Figure 6:
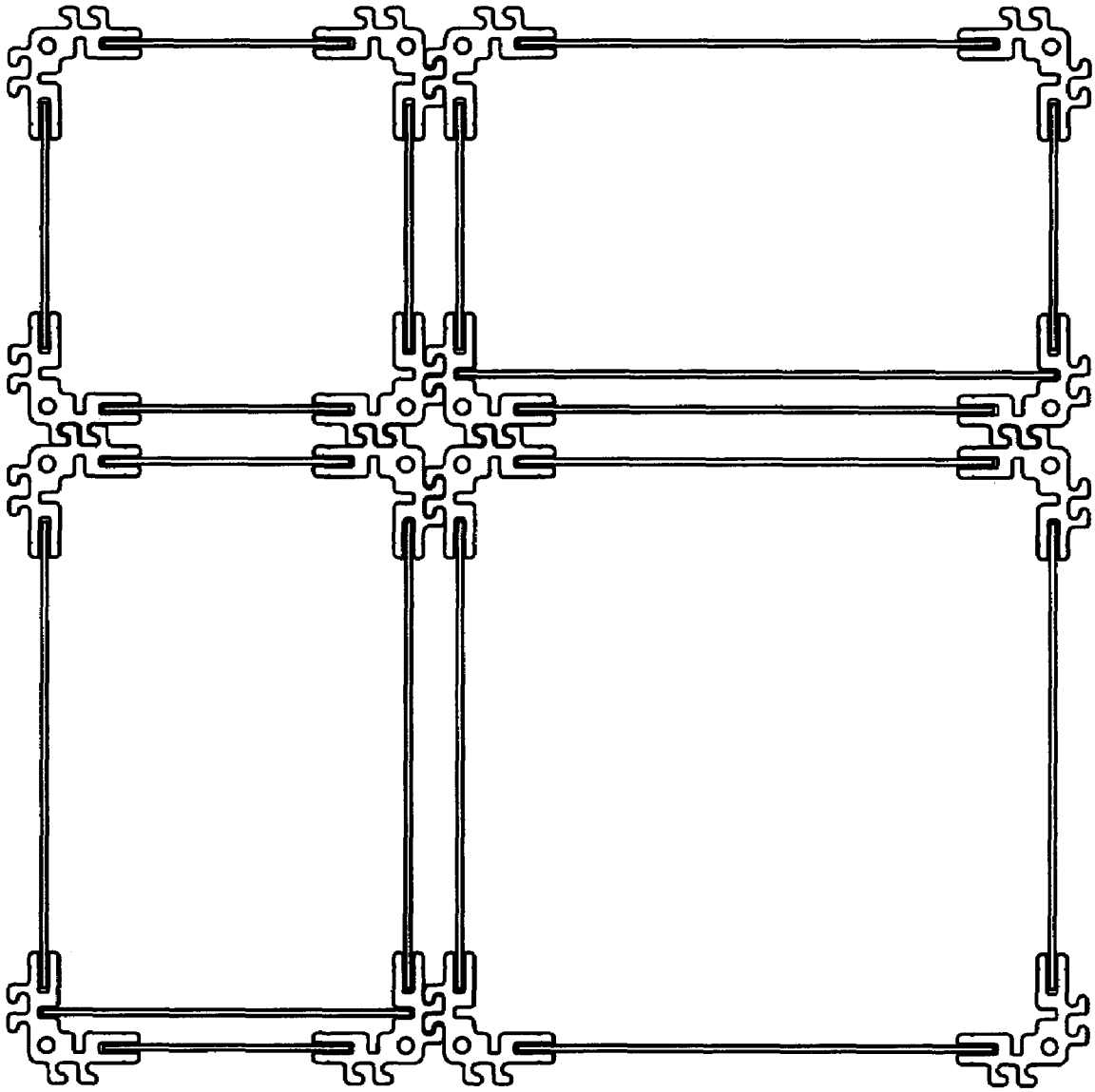
FIG. 6 is a front view of an enclosure with four compartments, two of which include internal mounting plates.

FIG. 6 shows a front view of an enclosure with four compartments in accordance with the invention. The enclosure of FIG. 6 is comprised of four smaller enclosures interlocked to each other. A single front and back panel can be used to complete the enclosure. This arrangement may be particularly useful if the enclosure is used to house electrical circuitry wherein it is desirable to shield each compartment from the others; or in situations where it is desirable to thermally isolate one compartment from another.

Figure 7:
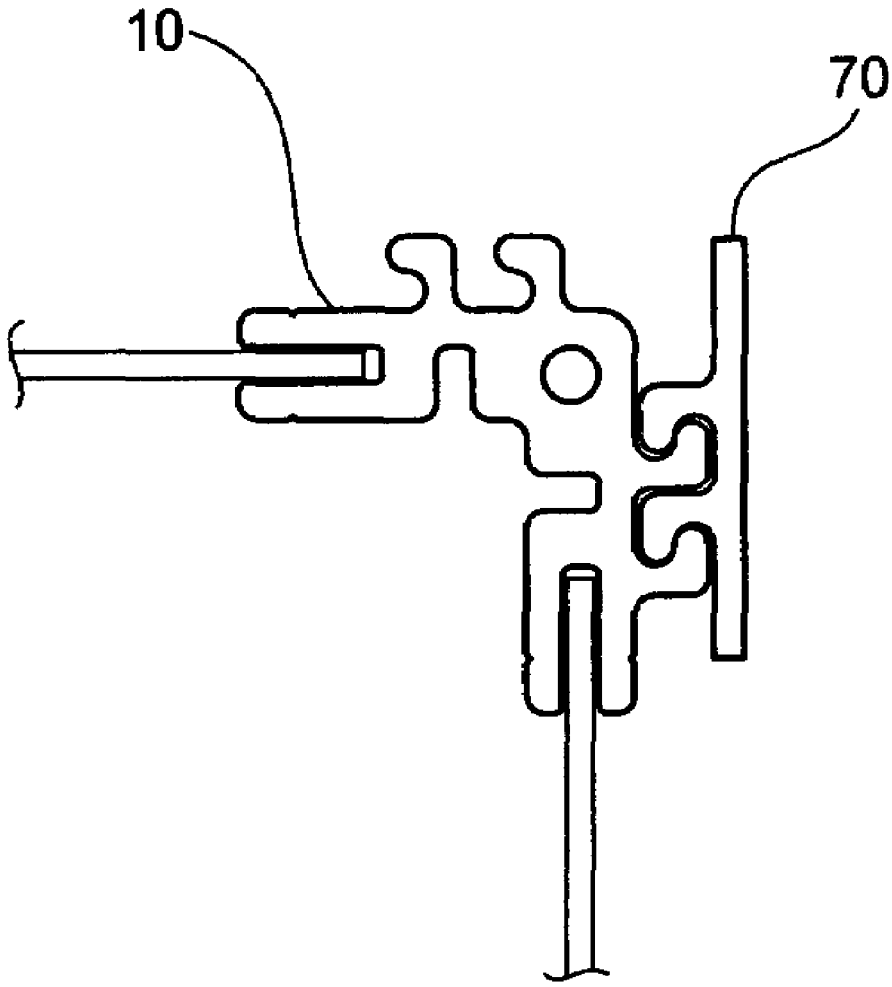
FIG. 7 is a front view of the corner of an enclosure assembly including an interlocking structure for external mounting of assemblies.

The interlocking means provided in the structural element are not limited to interlocking with identical structural elements. A flat plate with interlocking means on one side may be used to mount components external to the enclosure. FIG. 7 shows such a mounting plate 70 interlocked with a structural element 10 in a cutaway view of one corner of an enclosure. The interlocking protrusions on the mounting plate have the same shape as those on the structural element, but may be positioned in any desirable location on the mounting plate.

One skilled in the art will appreciate that the present invention can be practiced by other than the described embodiment, which is presented for purposes of illustration and not limitation, and the present invention is limited only by the claims that follow.

What is claimed is:

1. An elongated structural element for an enclosure comprising:

a first flange, a second flange attached to said first flange at a substantially right angle, a first interlocking protrusion located on the outer surface of said first flange, said first interlocking protrusion comprising a neck portion and a head portion, the width of said head portion being approximately twice the width of said neck portion, said head portion being offset from said neck portion such that one side of said first interlocking protrusion is essentially flat, the direction of said offset of said head portion being toward said second flange, the height of said first interlocking protrusion being approximately equal to the width of said head portion of said first interlocking protrusion, a second interlocking protrusion, said second protrusion being substantially identical in size, shape, and orientation to said first interlocking protrusion, said second interlocking protrusion being located on the outer surface of said first flange, the distance between said first interlocking protrusion and said second interlocking protrusion being approximately equal to the width of the neck portion of said first interlocking protrusion, a third interlocking protrusion comprising a neck portion and a head portion, said third protrusion being substantially identical in size and shape to said first interlocking protrusion, said third interlocking protrusion being located on the outer surface of said second flange, the direction of the offset of the head of said third interlocking protrusion being away from said first flange, a fourth interlocking protrusion comprising a neck portion and a head portion, said fourth protrusion being substantially identical in size, shape and orientation to said third interlocking protrusion, said fourth interlocking protrusion being located on the outer surface of said second flange, the distance between said fourth interlocking protrusion and said third interlocking protrusion being approximately equal to the width of the neck portion of said first interlocking protrusion, wherein said first and second interlocking protrusions can interlock to said third and fourth interlocking protrusions without intermediary components.

2. The elongated structural element of claim 1 further comprising a first slot extending inward from the outer edge of said first flange, substantially parallel to said first flange, and a second slot extending inward from the outer edge of said second flange, substantially parallel to said second flange.

3. The elongated structural element of claim 2 further comprising a first slot extending inward from the bottom surface of said first flange, substantially perpendicular to said first flange, and a second slot extending inward from the inner surface of said second flange, substantially perpendicular to said second flange.

4. The elongated structural element of claim 1 further comprising a first slot extending inward from the bottom surface of said first flange, substantially perpendicular to said first flange, and a second slot extending inward from the inner surface of said second flange, substantially perpendicular to said second flange.

5. The elongated structural element of claim 3 further comprising at least one hole extending the length of the structural element.

6. The elongated structural element of claim 5 further comprising at least one v-groove extending the length of the structural element.

7. The elongated structural element of claim 4 further comprising at least one hole extending the length of the structural element.

8. The elongated structural element of claim 7 further comprising at least one v-groove extending the length of the structural element.

* * * * *